US009138759B2

(12) United States Patent
Pravert

(10) Patent No.: US 9,138,759 B2
(45) Date of Patent: Sep. 22, 2015

(54) ELECTROSTATIC PROJECTOR COMPRISING A ROTATION SPEED DETECTION DEVICE

(75) Inventor: Christophe Pravert, Grenoble (FR)

(73) Assignee: Sames Technologies, Meylan (FR)

( * ) Notice: Subject to any disclaimer, the term of this patent is extended or adjusted under 35 U.S.C. 154(b) by 444 days.

(21) Appl. No.: 13/148,559

(22) PCT Filed: Feb. 8, 2010

(86) PCT No.: PCT/FR2010/050201

§ 371 (c)(1),
(2), (4) Date: Nov. 14, 2011

(87) PCT Pub. No.: WO2010/089519

PCT Pub. Date: Aug. 12, 2010

(65) Prior Publication Data

US 2012/0048196 A1 Mar. 1, 2012

(30) Foreign Application Priority Data

Feb. 9, 2009 (FR) ..... 09 50797

(51) Int. Cl.

*B05C 11/00* (2006.01)
*B05B 5/04* (2006.01)
*B05B 5/08* (2006.01)

(Continued)

(52) U.S. Cl.

CPC ..... *B05B 5/04* (2013.01); *B05B 3/1064* (2013.01); *B05B 5/0422* (2013.01); *B05C 11/00* (2013.01); *B05B 3/1085* (2013.01); *B05B 5/0407* (2013.01); *B05B 5/0415* (2013.01); *B05B 5/0418* (2013.01); *B05B 5/0533* (2013.01); *B05B 5/10* (2013.01);

(Continued)

(58) Field of Classification Search

None

See application file for complete search history.

(56) References Cited

U.S. PATENT DOCUMENTS 4,361,288 A 11/1982 Fukuda et al.
5,238,707 A * 8/1993 Weder et al. ..... 427/212

(Continued)

FOREIGN PATENT DOCUMENTS

GB 2068152 A 8/1981
JP H02-075152 6/1990

(Continued)

OTHER PUBLICATIONS

International Search Report for application No. PCT/FR2010/050201 dated May 25, 2010.

(Continued)

*Primary Examiner* — Dah-Wei D Yuan
*Assistant Examiner* — Jethro M Pence
(74) *Attorney, Agent, or Firm* — Patterson & Sheridan, L.L.P.

(57) ABSTRACT

The invention relates to an electrostatic projector ($P_1$) comprising: an insulation body (1); a rotatably movable projection member (2); rotational driving means (7); high-voltage power supply means (26); conducting elements (2.1, 6, 22, 23); a detection device (40) for evaluating the rotation speed of the projection member (2), the detection device (40) including at least one target (41, 42) on a rotary component and a sensor (43) adapted for detecting the or each target. The projector ($P_1$) further includes at least one insulating wall (50) that defines a housing (51) surrounding the sensor (43) for insulating the entire sensor (43) from the conducting elements (2.1, 6, 22, 23). The sensor (43) is separated from the space (V) scanned by the rotating target (41, 42) by an essentially axial detection distance (H).

14 Claims, 4 Drawing Sheets

(51) Int. Cl.

| | |
|---|---|
| ***B05B 5/10*** | (2006.01) |
| ***B05B 5/025*** | (2006.01) |
| ***B05B 5/053*** | (2006.01) |
| ***B05B 7/08*** | (2006.01) |
| ***B05B 3/02*** | (2006.01) |
| ***B05B 3/10*** | (2006.01) |
| *B05B 13/04* | (2006.01) |

(52) U.S. Cl.
CPC ..... *B05B 7/0815* (2013.01); *B05B 13/0431* (2013.01)

(56) References Cited

U.S. PATENT DOCUMENTS

| | | | | |
|---|---|---|---|---|
| 5,697,559 | A | 12/1997 | Davis et al. | |
| 6,206,307 | B1 * | 3/2001 | Kelly et al. | 239/690 |
| 2005/0173018 | A1 * | 8/2005 | Herre et al. | 141/91 |
| 2006/0175439 | A1 | 8/2006 | Steur et al. | |
| 2008/0236208 | A1 * | 10/2008 | Miyata et al. | 68/5 C |
| 2011/0259974 | A1 * | 10/2011 | Cooper et al. | 239/70 |

FOREIGN PATENT DOCUMENTS

| | | | |
|---|---|---|---|
| JP | H02-174956 | A | 7/1990 |
| JP | H02-290269 | | 11/1990 |
| WO | 2005/079996 | A1 | 9/2005 |
| WO | 2006/129407 | A1 | 12/2006 |

OTHER PUBLICATIONS

Japanese Office Action dated Feb. 10, 2014 for Japanese Patent Application No. 2011-548757 (with English translation).

* cited by examiner

ELECTROSTATIC PROJECTOR COMPRISING A ROTATION SPEED DETECTION DEVICE

The present invention relates to an electrostatic atomizer for spraying a coating material, which atomizer includes a detector device for evaluating the speed of rotation of an atomizer member forming part of the electrostatic atomizer.

Conventional spraying by means of an electrostatic atomizer is used to apply a coating material on articles to be coated, such as motor vehicle bodies. The term "coating material" is used to mean any material that is to be sprayed onto an article to be coated in powder or in liquid form, e.g. a primer, a paint, a varnish, etc.

In order to spray a material in powder or in liquid form, it is known that an electrostatic atomizer can be used that has a coating-material atomizer member that is mounted to rotate relative to a stationary body of the atomizer. Such an atomizer member, which, in general, is in the shape of a dish or of a cup, makes it possible to spray a jet of coating material with uniform distribution, and to impart high electric charge to the particles or droplets of coating material that are sprayed in that way.

In order to guarantee constant and repeatable spray quality and effectiveness, it is necessary to regulate, and thus to measure, the speed of rotation of the atomizer member. Regulating the speed of rotation of the spray member consists in modifying the setpoint sent to the rotary drive means as a function of comparing said setpoint with the measured speed of rotation.

FR-A-2 493 398 describes an electrostatic atomizer including means for raising the potential of the coating material, an air turbine for driving the atomizer member in rotation, and a device for evaluating the speed of rotation of the atomizer member on the basis of the difference between the inlet pressure and the outlet pressure of said air turbine. The speed-of-rotation measurements delivered by such a device are not accurate because numerous parameters influence the inlet pressure and the outlet pressure of that air turbine, e.g. a partially blocked inlet channel or outlet channel.

In addition, in order to evaluate the speed of rotation of the atomizer member, it is known that a detector device can be used that has a microphone as a sensor and a target disposed on a rotary component of the atomizer in such manner as to generate air pressure pulses. The microphone reacts to each pulse, and thus to each turn through which the target travels, by generating electrical signals that are then counted so as to determine the speed of rotation. Such a detector device requires precision machining and precision assembly of the components involved in such detection, and such machining and assembly is therefore costly.

In addition, the electrostatic atomizer must be coupled to a compressed air source, and a return duct must be provided for feeding the pneumatic signal back to the microphone, and such a duct increases the overall radial size of the atomizer at its fitting plane in which the couplers and connectors necessary for feeding and powering the atomizer lie. In addition, that compressed air source consumes energy continuously. Furthermore, it is often necessary to process the signal delivered by the microphone in order to reduce unwanted noise.

FR-A-2 504 029 describes an electrostatic atomizer provided with an optical detector device for detecting the speed of rotation of the rotary atomizer member. That optical detection uses a light emitter-receiver and a reflective target disposed on a rotary component of the atomizer. Such a detector device requires an optical fiber for emitting the light and an optical fiber for receiving the light pulses reflected by the target. Those optical fibers are particularly long since the light emitter-receiver is generally placed some distance away from the target.

Unfortunately, optical fibers are fragile and they can be broken when they are subjected to too much bending and/or torsion stress, as applies frequently in an electrostatic atomizer mounted on the wrist of a multi-axis robot. Such a detector device is thus costly to install and to maintain.

GB-A-2 068 152 describes an atomizer having a body incorporating the rotary drive means for driving the atomizer in rotation. A sensor is mounted outside the body and in a recess formed by a wall made of a conductive material and connected to ground potential. That recess formed by a wall made of a conductive material must be far enough away from the high-voltage elements to avoid any insulation breakdown, over-consumption, or sparking, etc.

EP-A-0 481 247 describes an electrostatic atomizer including a detector device comprising a magnetic sensor and two targets constituted by magnets disposed on the wheel of the air turbine that drives the atomizer member in rotation. The detector device comprises a sensor formed of a solenoid placed in the vicinity of the turbine wheel, so that each time a magnet-target goes past the sensor, an electrical pulse is generated in the solenoid. The solenoid of the sensor transmits electrical pulses to a counting unit that evaluates the speed of rotation. In an electrostatic atomizer, the atomizer member, and, generally, certain components of the turbine, e.g. the wheel, are under high voltage. That is why the solenoid of the sensor is connected to the counting unit via a high-voltage cable that conducts the electrical pulses, and via an isolating solenoid influenced by the high-voltage cable.

The isolation of the high-voltage cable can be insufficient in view of the external electromagnetic interference, which might induce unwanted signals at the counting unit, thereby distorting the evaluation of the speed of rotation. In addition, the high-voltage cable forms a capacitor that represents a hazard for operators during maintenance of the atomizer. That high-voltage cable is also bulky and difficult to fit and to manipulate. In addition, such a detector device is relatively costly, because two solenoids are necessary, including the solenoid of the sensor that has a specific structure, and a high-voltage cable is also necessary. Furthermore, such an atomizer suffers from increased risks of generating electric arcs between a portion of the high-voltage cable and the fitting plane of the atomizer or a medium-voltage power cable.

A particular object of the present invention is to remedy those drawbacks, by proposing an electrostatic atomizer equipped with a detector device that is accurate, reliable, robust, inoffensive, of simple construction, and of low cost.

To this end, the invention provides an atomizer for electrostatically spraying coating material in liquid or in powder form, said atomizer comprising:

- an electrically insulating body;
- an atomizer member for spraying coating material, which member is mounted to rotate relative to the body and about an axis of rotation;
- rotary drive means for driving the atomizer member in rotation;
- electrical power supply means arranged for raising the potential of the atomizer member to high voltage;
- conductive elements that are electrically connected to the electrical power supply means and that belong, in particular, to the atomizer member, to the rotary drive means, and to the electrical power supply means, the potential of the conductive elements being suitable for being raised to high voltage; and a detector device for evaluating the speed of rotation of the atomizer member, the detector device comprising:

at least one target disposed on a rotary component belonging to the atomizer, such as the atomizer member or one of the rotary drive means; and a sensor fastened in the atomizer, the sensor being configured to detect the or each target, the sensor being equipped with a link cable for linking it to a remote processor unit for processing the signal.

The atomizer further comprises at least one wall made of an insulating material, the wall defining a recess surrounding the sensor and all or some part of the link cable in a manner such as to insulate the entire sensor and all or some part of the cable link electrically from the conductive elements. The sensor is separated from the volume swept by the rotating target by a detection distance extending essentially parallel to the axis of rotation.

Thus, the sensor and a portion of the link cable are insulated and protected from the high voltage and thus from the risks of insulation breakdown over the portions of the sensor that are connected to the low voltage.

According to advantageous but optional characteristics of the invention that are taken in isolation or in any technically feasible combination:

the sensor is separated from the volume swept by the rotating target by a detection distance extending essentially parallel to the axis of rotation;

the wall is formed by a portion of the body;

the wall is formed by a separate part mounted in the body;

a portion of the wall extends facing the sensor on one side and facing the volume swept by the rotating target on the other side, said portion of the wall being disposed substantially axially between the sensor and the volume swept by the rotating target;

the portion of the wall and the volume swept by the rotating target are separated by an axial distance lying in the range 1 mm to 10 mm;

the wall has a thickness greater than 3 mm when the potential of the atomizer member is to be raised to more than 50 kV;

the recess extends in a direction that is substantially parallel to the axis of rotation;

the sensor is selected from among the group comprising a magnetic sensor, a magneto-resistive sensor, a Hall-effect sensor, an inductive sensor, a magneto-inductive sensor, and a capacitive sensor;

at least one material forming the wall is selected from among the group comprising: polyoxymethylene copolymer (POM C), polyethylene terephthalate (PETP), polyvinyl chloride (PVC), polyethylene (PE), poly-propylene (PP), polyetheretherketone (PEEK), and poly-tetrafluoroethylene (PTFE);

the rotary drive means comprise a turbine provided with a bladed wheel, and the rotary component is constituted by the bladed wheel, the or each target being disposed on an axial surface of the bladed wheel;

the or each target is constituted by a shape discontinuity, such as an indented or projecting piece in relief;

the or each target is constituted by a material discontinuity, the or each target comprising, for example, a conductive material or a magnetic material; and the or each target is constituted by a physical property discontinuity.

The invention can be well understood and its advantages also appear from the following description that is given merely by way of non-limiting example and with reference to the accompanying drawings, in which:

FIG. 1 shows an atomizer $P_1$ including a body 1 and an atomizer member 2 for spraying a material in powder form for coating an article such as a motor vehicle body.

Figure 1:
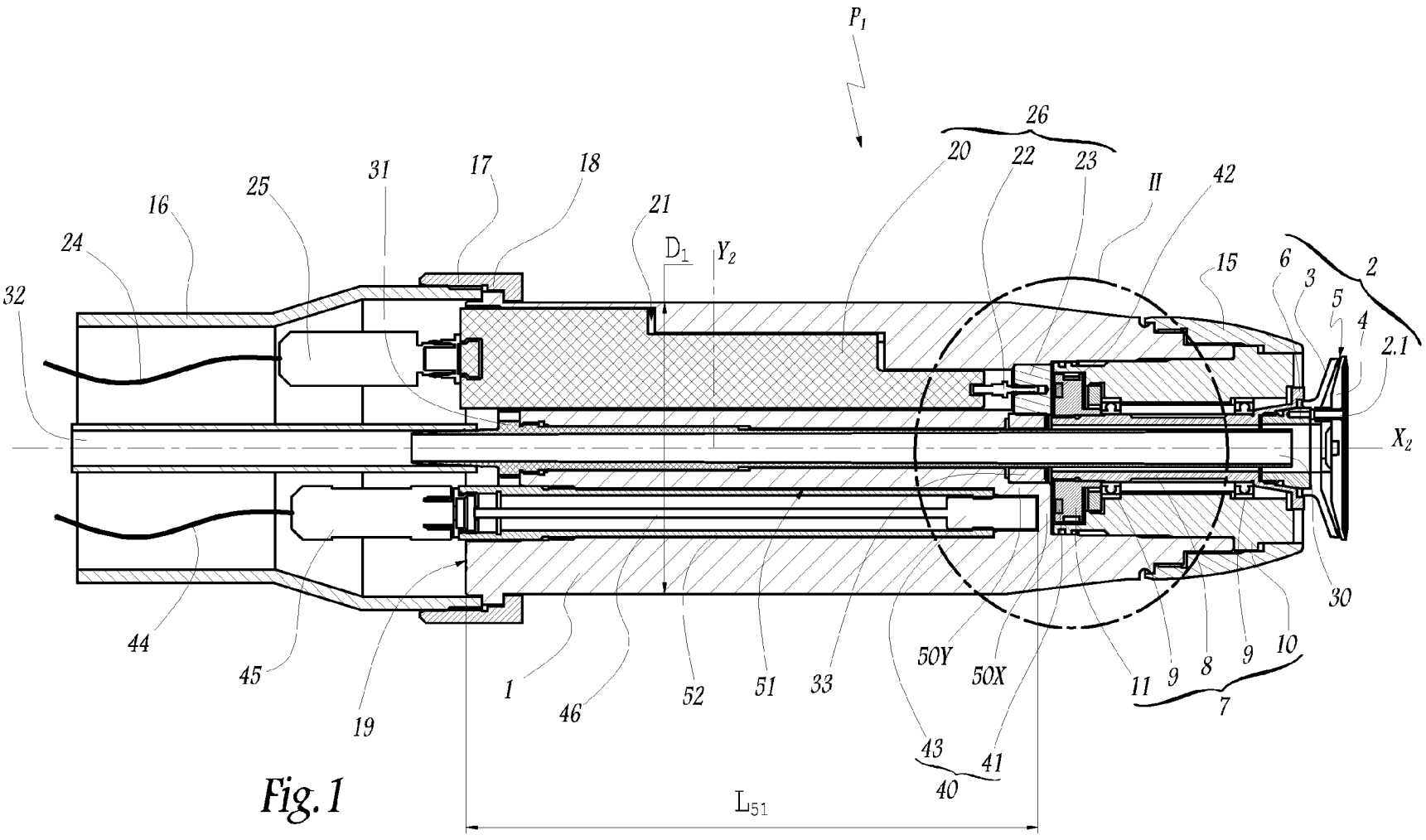
FIG. 1 is a section view of a first embodiment of an atomizer of the invention.

The atomizer member 2 comprises a cup 3 and a disk 4 that are secured together and that, together, define an ejection interstice 5 for ejecting the material in powder form. The atomizer member 2 further comprises a base 6 to which the cup 3 and the disk 4 are fastened. The atomizer member 2 is mounted at the downstream end of the atomizer $P_1$.

More precisely, the base 6 is fastened to the downstream end of a shaft 8 belonging to a turbine 7. The shaft 8 is supported by bearings 9 in a casing 10 of the turbine 7. The casing 10 of the turbine 7 is secured to the downstream portion of the body 1 by means of a nut 15. The turbine 7 further includes a bladed wheel 11 that is secured to the upstream portion of the shaft 8. The body 1 covers a substantial portion of the casing 10. The terms "upstream" and "downstream" are used herein with reference to the general direction of flow of the coating material through the atomizer $P_1$.

The turbine 7 is also provided with channels (not shown) arranged to direct the compressed air onto the blades of the bladed wheel 11. In operation, the compressed air injected onto the blades drives the bladed wheel 11 in rotation, and also drives the shaft 8 and the atomizer member 2 in rotation, about an axis of rotation $X_2$. The turbine 7 thus forms drive means for driving the atomizer member 2 in rotation about the axis $X_2$.

While an electrostatic atomizer for spraying coating material in powder form is spraying, the speed of rotation of the atomizer member generally lies in the range 5000 revolutions per minute (rpm) to 10,000 rpm. While an electrostatic atomizer for spraying coating material in liquid form is spraying, the speed of rotation of the atomizer member generally lies in the range 35,000 rpm to 80,000 rpm.

The atomizer $P_1$ may be fastened to a wrist 16 of a multi-axis robot designed to move the atomizer $P_1$ relative to an article to be coated. In practice, the atomizer $P_1$ is equipped with a nut 17 that holds an upstream shoulder 18 of the body 1 stationary against the wrist 16. The upstream axial surface of the body 1 defines a fitting plane 19 that forms an interface with the wrist 16.

The atomizer $P_1$ further comprises electrical power supply means 26 for raising the potential of the atomizer member 2 to high voltage. In the present application, the terms "potential", "voltage", and "current" designate respectively electric potential, electric potential difference or electric "tension", and electric current. Similarly, the adjective "conductive" and the verbs "conduct", "connect", and "interconnect" refer to conducting electricity by means of a solid or liquid conductor, or by means of two parts in contact and in relative movement, or by induction.

The electrical power supply means 26 comprise a high-voltage unit 20 that is disposed in a chamber 21 of complementary shape that is provided in the body 1. The high-voltage unit 20 is electrically powered by means of a power cable 24 that is mounted on a power connector 25, itself connected to the high-voltage unit 20 at the fitting plane 19. In a variant (not shown), the high-voltage unit may be placed outside the atomizer. In such a variant, a high-voltage cable is arranged between the high-voltage unit and the inside of the atomizer. Such a high-voltage cable thus constitutes electrical power supply means for raising the potential of the atomizer member to high voltage.

The high-voltage unit 20 and the atomizer member 2 are electrically interconnected via conductive elements. The outlet of the high-voltage unit 20 is in contact with a pin 22 that is, itself plugged into a seat 23 made of a conductive material. The seat 23 is electrically connected to the shaft 8, and thus to the atomizer member 2, via a ring 33.

The pin 22, the seat 23, the ring 33, the shaft 8, and the base 6 are "conductive" elements because they are made of conductive materials. The atomizer member 2 includes other conductive elements, e.g. a pin 2.1 and the disk 4, for charging the material particles before they exit via the ejection interstice 5. The atomizer member 2 also includes an electrode for bringing the particles or the droplets of coating material to a high potential. Such an electrode thus forms a conductive element. In the example shown in FIGS. 1 to 4, the electrode can be constituted by the disk 4. In addition, in this example, the casing 10 and the bladed wheel 11 are made of insulating materials. Alternatively, the casing 10 and the bladed wheel 11 may be made of conductive materials.

These conductive elements are connected directly or indirectly to the high-voltage unit 20 and they are part of the atomizer member 2, of the turbine 7, or of the electrical power supply means 26. The electric potential of each of these conductive elements can be high at high direct current (DC) voltage, typically lying in the range 10 kilovolts (kV) to 100 kV.

In order to feed the atomizer member 2 with coating material in powder form, the atomizer $P_1$ includes a tube 30 having a circular base. The tube 30 extends coaxially with the axis $X_2$ and through the body 1 and the turbine 7. The upstream end of the tube 30 has a coupling 31 fitted into a pipe 32. The pipe 32 extends through the wrist 16 in such a manner as to bring the coating material to the atomizer $P_1$ from a reservoir (not shown). The downstream end of the tube 30 opens out into a cylindrical bore in the base 6 of the atomizer member 2.

In addition, the atomizer $P_1$ has a detector device 40 for evaluating the speed of rotation of the atomizer member 2. The detector device 40 comprises two targets 41 and 42 disposed on the bladed wheel 11, and a sensor 43 fastened in the body 1 of the atomizer $P_1$.

Figure 2:
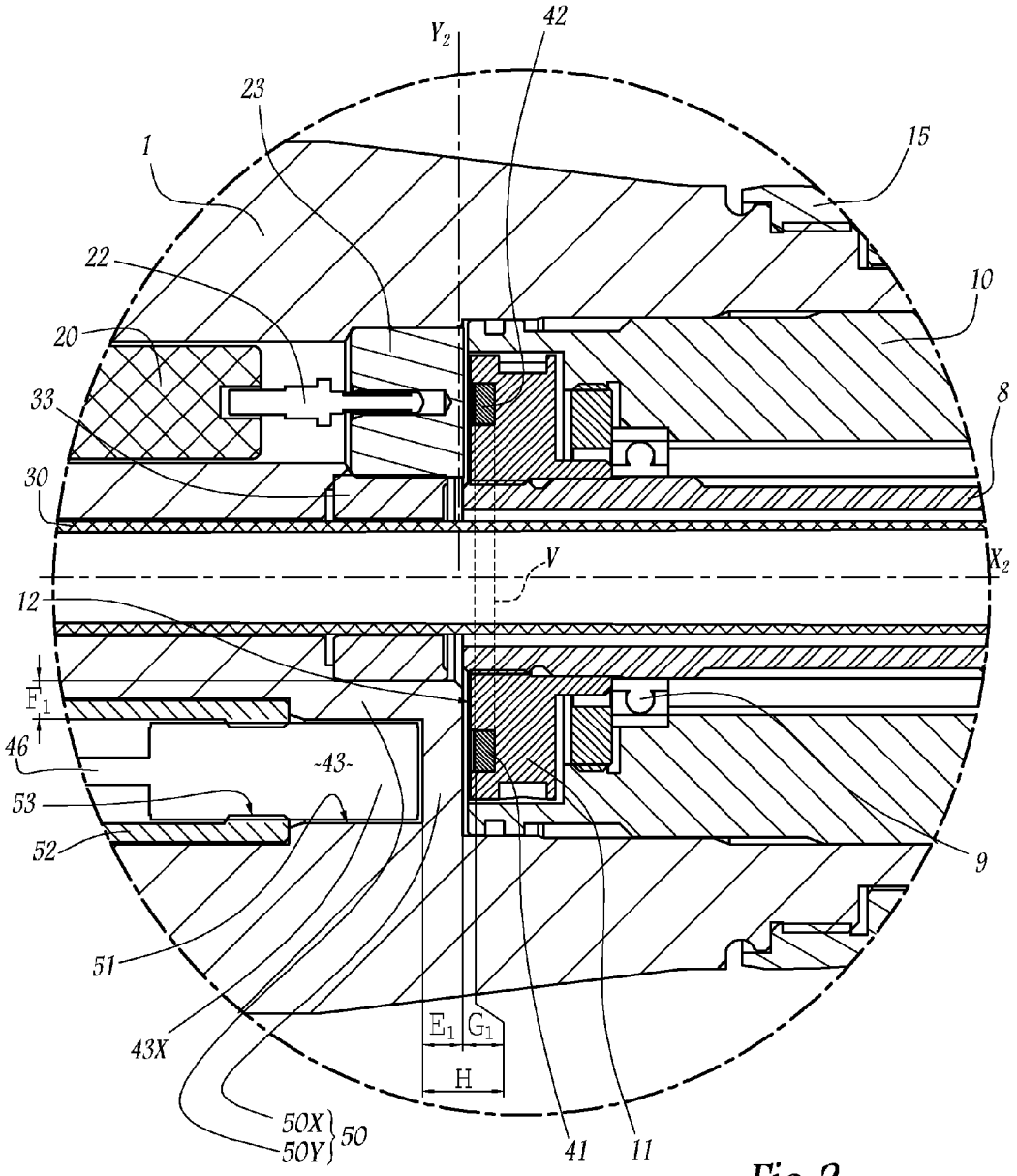
FIG. 2 is a view on a larger scale of the detail II in FIG. 1.

As shown in FIG. 2, each target 41 or 42 is formed of a pad incorporated in the bladed wheel 11. In practice each target 41 or 42 is received in a respective bore of corresponding shape that is formed in the bladed wheel 11 in such a manner as to open out in a upstream axial surface 12 of the bladed wheel 11. The targets 41 and 42 are disposed at the same radial distance from the axis $X_2$ and they occupy diametrically opposite positions, in such a manner as to balance the bladed wheel 11 by mutual compensation of the inertias of the rotating targets 41 and 42.

In the present application, a direction or distance is said to be "axial" or "radial" respectively when it is parallel to or when it is perpendicular to the axis $X_2$. In the present application, a surface is said to be "axial" or "radial" as a function of the direction that is followed by a normal to the surface. An axial surface is thus substantially perpendicular to the axis $X_2$.

In practice, each of the targets 41 and 42 is of cylindrical shape, and is fastened to the bladed wheel 11 by adhesive bonding, by force-fitting, or by any other equivalent means of holding in position.

Each target 41 or 42 is constituted by a permanent magnet, while the bladed wheel 11 is constituted by a material that is not magnetic or that has low magnetic permittivity. In practice, each target 41 or 42 may be made of a ferromagnetic or ferrimagnetic material. Each target 41 or 42 thus forms a material or physical property discontinuity. Preferably, each target 41 and 42 is made of a rare earth or of some other material having high magnetic permittivity, thereby enabling each target 41 or 42 to be relatively compact while also generating a relatively powerful and detectable magnetic field. The magnetic field of each target 41 or 42 is oriented parallel to the axis $X_2$. The polarity of each target 41 or 42 is oriented as a function of the detection direction of the sensor 43.

In this example, the sensor 43 is of the Hall-effect type in this example. More generally, the sensor detecting the targets can be of the active or passive type, depending on the nature of the target to be detected. The sensor 43 may be selected from the group comprising a magnetic sensor, a magneto-resistive sensor, a Hall-effect sensor, an inductive sensor, a magneto-inductive sensor, and a capacitive sensor.

A sensor selected in this way makes it possible to detect the targets both at high speeds of rotation and at low speeds of rotation. It does not need compressed air, thereby saving energy, and it is insensitive to any pollution of the detection zone by the coating material. In addition, such a sensor is compact. Said sensor is selected to have a long detection range, thereby making it possible to provide an insulating wall that is relatively thick.

In addition, such a sensor must work at high frequencies, thereby making it possible to detect high speeds of rotation. In order to measure high speeds of rotation such as the speeds mentioned above, the selected sensor must be adapted to effect target detection at high frequencies, of the order of several kilohertz (kHz).

In a radial direction, the sensor 43 is disposed in the atomizer $P_1$ approximately at the same radial distance from the axis $X_2$ as each of the targets 41 and 42. In an axial direction, the sensor 43 is disposed in the atomizer $P_1$ at a detection distance H from the volume V swept or travelled by the targets 41 and 42 while they are rotating about the axis $X_2$. The volume V is shown in dashed lines in FIG. 2. The volume V thus has an annular shape that is coaxial with the axis $X_2$. The detection distance H, measured parallel to the axis $X_2$, is about 6 mm in this example. In practice, as a function of the sensitivity of the sensor used, the detection distance is determined so that the sensor detects each target once during each revolution of each target.

In operation, the potential of the sensor 43 is brought to a low or zero voltage if it is connected to ground. The sensor 43 is insulated relative to the conductive elements of the atomizer $P_1$, namely, in particular, the atomizer member 2, the part 33, the shaft 8, and the targets 41 and 42, which elements are raised to a high voltage potential.

In the present application, the terms "insulate", "insulating", and "insulation" relate to the property of electrical insulation that prevents or considerably limits electricity conduction.

In order to insulate the sensor 43 from the conductive elements, the atomizer $P_1$ further comprises a wall 50 that is formed by a portion of the body and that defines a recess 51 for the sensor 43. The body 1 covers the recess 51 and thus the wall 50. The body 1, and therefore the wall 50, are made of one or more insulating material(s). In other words, the wall 50 is formed integrally with the body 1. In practice the materials forming the body 1 and the wall 50 are selected from the group comprising polyoxymethylene copolymer (POM C), polyethylene terephthalate (PETP), polyvinyl chloride (PVC), polyethylene (PE), polypropylene (PP), polyetheretherketone (PEEK), and polytetrafluoroethylene (PTFE).

The recess 51 extends in a direction parallel to the axis $X_2$, from the fitting plane 19 to the detection region situated a little upstream from the volume V. The recess 51 has a cylindrical shape. The recess 51 is made up of a downstream portion, defined by the wall 50, which portion receives the sensor 43, and of an upstream portion that receives a link cable 46 that conveys the current for powering the sensor 43 and the electrical signals generated by the sensor 43 while the targets 41 and 42 are rotating. At the fitting plane 19, the link cable 46 is connected to a signal connector 45, itself connected to a signal cable 44 that extends in the wrist 16, to a signal processor unit (not shown).

As shown in FIG. 2, the recess 51 surrounds the sensor 43 and a portion of its link cable 46. The entire sensor 43 is thus insulated from the conductive elements of the atomizer $P_1$, which elements are disposed essentially downstream from the sensor 43. Thus, the sensor 43 and a portion of the link cable 46 are insulated and protected from the high voltage and thus from the risks of insulation breakdown over the portions of the sensor that are connected to the low voltage.

Since the downstream portion of the recess 51 is a close fit around a portion of the sensor 43 (ignoring assembly clearances), it is easy to position the sensor 43 in the recess 51.

As shown in FIG. 2, in order to put the sensor 43 in place in and at the end of the recess 51, the sensor 43 is firstly screwed into the end of a sheath 52. The sheath 52 is in the shape of a tube that is open at both of its ends. The sheath 52 is rigid, thereby enabling it to hold the sensor 43 and to thread it into its detection position at the downstream end of the recess 51. The sheath 52 has a tubular shape that coincides with the cylindrical radial surface of the recess 51, thereby enabling the link cable 46 to pass inside and along the sheath 52.

An axial portion 50X of the wall 50 extends facing the sensor 43 on one side and facing the volume V on the other side. The axial portion 50X thus extends substantially radially. The axial portion 50X is disposed axially between the sensor 43 and the volume V. In other words, the axial portion 50X of the wall 50 is disposed, in a direction parallel to the axis $X_2$, between the downstream axial surface of the recess 51 and the upstream surface of the casing 10. The axial portion 50X of the wall 50 and the volume V are separated by an axial distance $G_1$ of about 1 millimeter (mm). In practice, the axial distance $G_1$ lies in the range 1 mm to 10 mm. The sensor 43 must have a detection distance H greater than the sum of the axial thickness of the wall 50X and of the axial distance $G_1$.

In practice, given the materials used for making the wall 50, the axial portion 50X of the wall 50 has a thickness $E_1$ of about 5 mm, in order to insulate the sensor 43 effectively from the high voltage that is used. In practice, the thickness $E_1$ is chosen to be greater than 5 mm.

In addition, a radial portion 50Y of the wall 50 extends between the cylindrical surface of the recess 51 and the axis $X_2$. The thinnest portion of the radial portion 50Y of the wall 50 extends between the cylindrical surface of the downstream portion of the recess 51 and a radial surface of the ring 33. This thinnest portion of the radial portion 50Y of the wall 50 has a thickness $F_1$ of about 5 mm.

Thus, the sensor 43 may be mounted in the vicinity of the targets 41 and 42, ignoring the insulation distance. This arrangement represents high compactness in the radial direction $Y_2$, which limits the overall size of the atomizer $P_1$.

The respective thicknesses $E_1$ and $F_1$ of the axial portion 50X and of the radial portion 50Y of the wall 50 are determined as a function of the dielectric permittivity of the material forming the insulating wall and as a function of the expected potential difference between the sensor 43, which is brought to low or zero voltage, and the conductive elements of the atomizer $P_1$, the potentials of which are brought to high voltages.

In addition, the recess 51 has a length $L_{51}$, as measured along the axis $X_2$, of approximately in the range 100 mm to 150 mm for a high voltage of in the range 50 kV to 100 kV. The length $L_{51}$ is essentially determined as a function of the remoteness necessary between the fitting plane 19 and the conductive elements.

In operation, during the electrostatic spraying, the coating material in powder form is transported pneumatically to the atomizer member 2 through the pipe 32 and then through the tube 30. From upstream to downstream, the coating material thus flows through the atomizer $P_1$ from the fitting plane 19 to the atomizer member 2.

The high-voltage unit 20 is electrically powered and operated via the power cable 24 and via the power connector 25. The electrical power supply means 26 then raise the potentials of the conductive elements of the atomizer $P_1$ to high voltage, in particular the potentials of the pin 22, of the seat 23, of the ring 33, of the shaft 8, of the base 6, of the pin 2.1, and of the disk 4. The material in powder form then flows along the cup 3 from the base 6 to the ejection interstice 5, where each of its particles accumulates electrostatic charge.

The sensor 43 generates a signal variation that is usable every time a target 41 or 42 goes past close to its detection members. The resulting signal variations or electrical pulses that are generated by the sensor 43 flow through the link cable 46, and then through the signal connector 45 and through the signal cable 44, to a counting unit (not shown). The counting unit is associated with an electronic circuit that determines the speed of rotation of the atomizer member 2 on the basis of said signal variations.

The use of a sensor implementing the Hall effect makes it possible to perform the detection function while increasing the accuracy of the measurement of the speed of rotation because it generates distinct signal variations in reliable and repeatable manner.

In addition, arranging the sensor 43 and the targets 41 and 42 in the axial direction significantly limits the radial dimensions of the body 1, i.e. its dimensions in a plane orthogonal to the axis $X_2$. Thus the substantially cylindrical body 1 has a diameter $D_1$ of about 100 mm, while the radial dimension of the sensor 43, measured in a direction $Y_2$ orthogonal to the axis $X_2$, is about 10 mm.

The ratio between the radial dimension of the sensor 43 and the diameter $D_1$ of the body 1 is about 10%. Thus any addition made by the sensor 43 to the overall radial size of the atomizer $P_1$ is small. Access for the atomizer $P_1$ in small volumes such as those involved for coating the inside surfaces of a motor vehicle body, and access through an opening in a spray booth depend directly on the overall radial size of the atomizer $P_1$.

In addition, in the atomizer $P_1$, it is possible to make the sheath 52 of a conductive material, when it is necessary to connect the outside surface of the sensor 43 to ground in order to avoid electromagnetic interference generated by the conductive elements and by the electrical power supply means 26 that are incorporated in the atomizer $P_1$.

Figure 3:
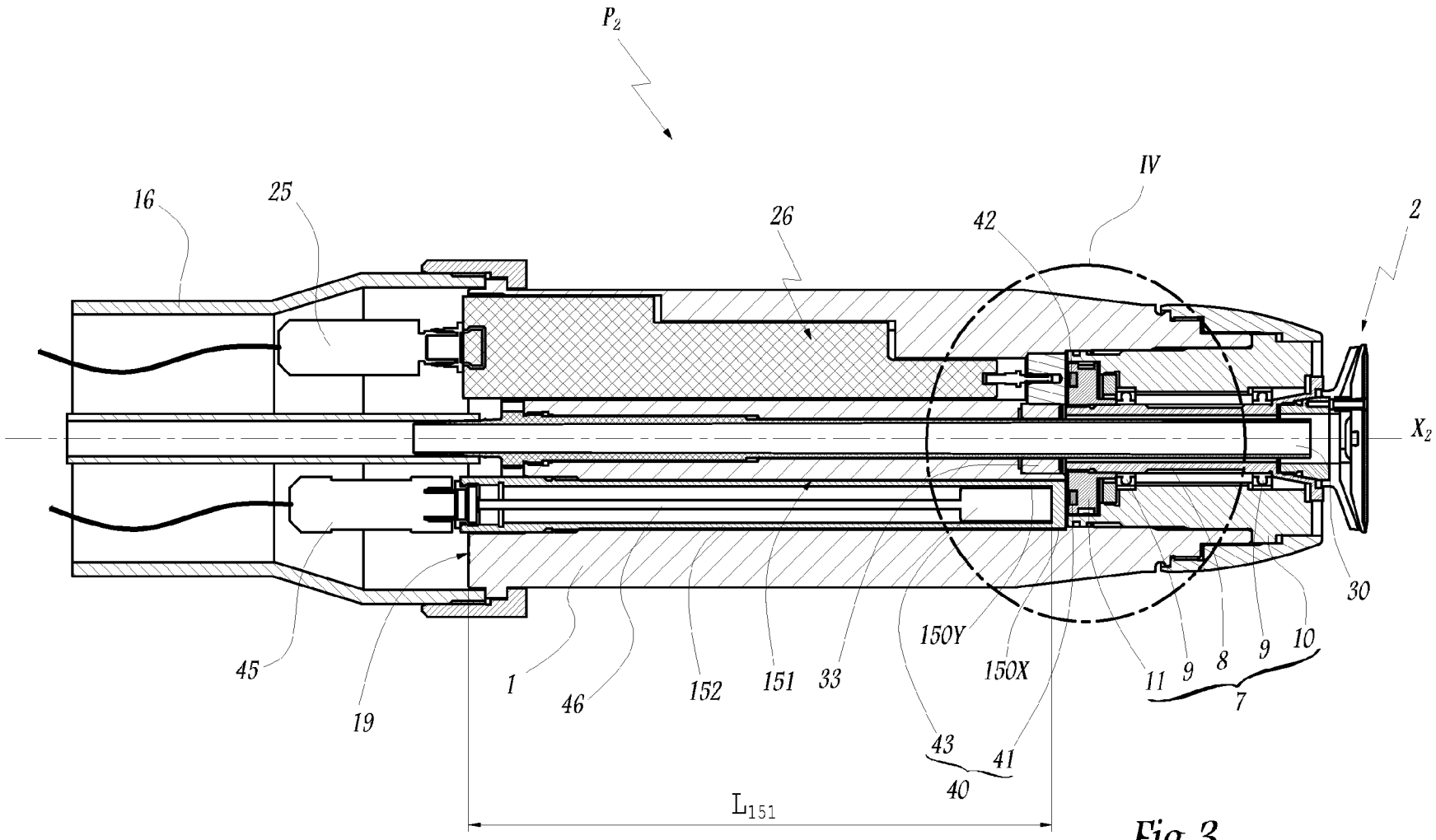
FIG. 3 is a view analogous to FIG. 1, showing a second embodiment of an atomizer of the invention.
Figure 4:
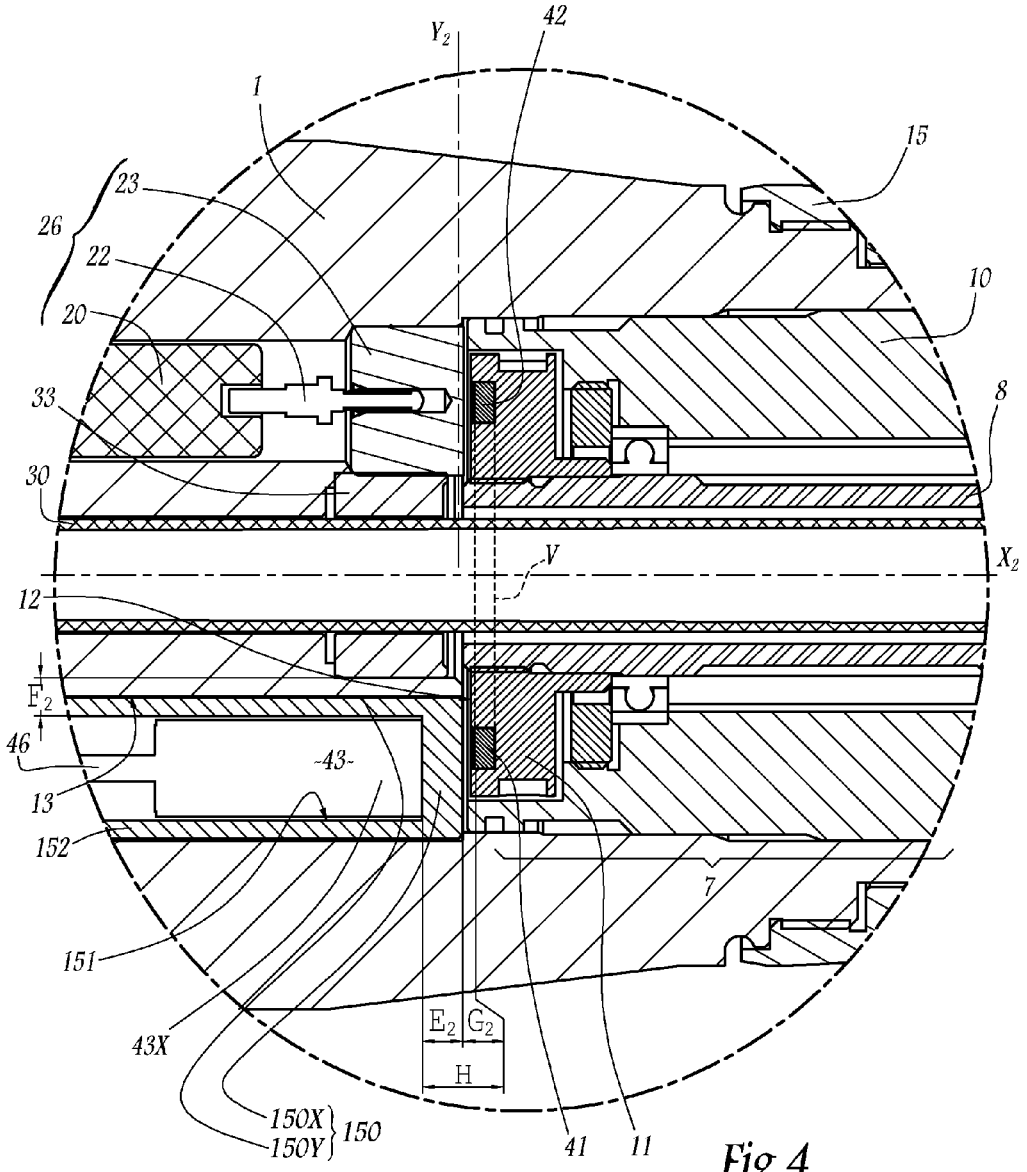
FIG. 4 is a view on a larger scale of the detail IV of FIG. 3.

FIGS. 3 and 4 show a second embodiment of an atomizer $P_2$ of the invention. The description of the atomizer $P_1$, given above with reference to FIGS. 1 and 2, can be transposed to the atomizer $P_2$ shown in FIGS. 3 and 4, except for the differences mentioned below. Elements of the atomizer $P_2$ that are similar or that correspond to elements of the atomizer $P_1$ bear like numerical references. The following are thus defined: the body 1, the atomizer member 2 and the axis of rotation $X_2$ thereof, the turbine 7, the robot wrist 16, the fitting plane 19, the power connector 25, and the signal connector 45, the electrical power supply means 26, the tube 30, the targets 41 and 42, and the sensor 43.

The atomizer $P_1$ differs from the atomizer $P_2$ by the structure and by the arrangement of the wall 50 and of the recess 51 that insulates the sensor 43 relative to the conductive elements of the atomizer $P_1$. Unlike the wall 50 of the atomizer $P_1$ that is formed by a portion of the body 1, the atomizer $P_2$ has a wall 150 that is formed by a sheath 152 in the form of a tube that is not open on the downstream side, where it is closed off by a disk formed integrally with the tube. The sheath 152 is mounted in a cylindrical bore 13 formed in the body 1, and visible in FIG. 4.

The wall 150 of the sheath 152 defines a recess 151 that surrounds the sensor 43 and a portion of its link cable 46. The body 1 partially covers the sheath 152 and thus partially covers the recess 151 and the wall 150. The axial portion 150X and the radial portion 150Y of the wall 150 are formed respectively by the downstream axial portion and by the cylindrical radial portion of the sheath 152. This construction of the atomizer $P_2$ induces relatively simple machining of the body 1.

The length $L_{151}$ of the recess 151 is chosen to be large enough to avoid any creep or propagation of high-voltage electric arcing along the sheath 152 between high-voltage conductive elements and the link cable 46 or the fitting plane 19 and the power connector 25 or the signal connector 45, given that they are connected to ground. To this end, the length $L_{151}$ is greater than 150 mm for voltage levels lying in the range 50 kV to 100 kV. Such electric arcing might damage or even destroy the electrical referencing of the sensor 43.

The sheath 152 must be made of an insulating material, such as polyoxymethylene copolymer (POM C). In practice, the materials forming the sheath 152 are selected from among the group comprising polyoxymethylene copolymer (POM C), polyethylene terephthalate (PETP), polyvinyl chloride (PVC), polyethylene (PE), poly-propylene (PP), polyetheretherketone (PEEK), and poly-tetrafluoroethylene (PTFE).

In the atomizer $P_2$, it is preferable to minimize the clearance between the sheath 152 and the body 1, so as to enable the sheath 152 to be mounted, and also so as to avoid electrical arc propagation between the sheath 152 and the body 1, to the conductive elements situated behind the atomizer and brought to low voltage or to ground potential.

The axial portion 43X of the sensor 43, where its detection members are situated, is disposed at the detection distance H from the volume V swept by the targets 41 and 42 moving in rotation about the axis $X_2$. The volume V is shown in dashed lines in FIG. 4. In order to insulate the sensor 43 from the conductive elements of the atomizer $P_2$, the thickness $E_2$ of the axial portion 150X of the wall 150 is equal to 5 mm. In practice, the thickness $E_2$ is greater than 3 mm. Similarly, the thickness $F_2$ of the radial portion 150Y of the wall 50, i.e. the radial thickness of the sheath 152, is equal to 5 mm. In practice, the thickness $F_2$ is greater than or equal to 3 mm.

The downstream axial portion 150X of the wall 150 extends facing the sensor 43 on one side and facing the volume V on the other side. The axial portion 150X of the wall 150 is disposed, parallel to the axis $X_2$, between the downstream axial surface of the recess 51 and the upstream surface of the casing 10. The axial portion 150X of the wall 50 and the volume V are separated by an axial distance $G_2$ of about 1 mm. In practice, the axial distance $G_2$ lies in the range 1 mm to 10 mm. Instead of being plane, as in the variant shown in FIGS. 3 and 4, the axial portion of the wall 150 may have pieces in relief that are set back or projecting relative to components of the turbine 7.

The thicknesses $E_2$ and $F_2$ are determined as a function of the dielectric permittivity of the material forming the insulating wall and as a function of the high voltage to which the potential of the conductive elements of the atomizer $P_2$ is brought.

In the atomizer $P_1$ and in the atomizer $P_2$, the sensor 43 and all or some part of the link cable are fully insulated from the conductive elements brought to the high voltage. In other words, all of the components of the sensor 43 and a portion of the link cable are insulated from the high voltage and can brought to low or zero potential, i.e. connected to ground.

Insulating the entire sensor 43 makes it possible to avoid any conduction of an electric arc through the components of the sensor 43 themselves, in order to protect and to guarantee the function of measuring the speed of rotation. Such an electric arc could be a spark point in an explosive atmosphere generated by the coating material. The invention thus procures a protective mode in an explosive atmosphere that is simple and inexpensive compared with an intrinsic safety barrier.

Since the sensor 43 is fully insulated from the conductive elements brought to high voltage, it may be arranged very close to the targets 41 and 42. It is thus possible to use a sensor that is relatively compact, less sensitive, not designed to withstand high voltages, and thus inexpensive.

In the atomizer $P_1$, the use of a sheath 52 that is made of metal and that is connected to ground forms shielding of the sensor 43 and of the link cable 46 relative to high levels of surrounding electromagnetic interference.

In the atomizer $P_2$, such shielding may be provided directly on the sensor 43 and on the link cable 46.

In a variant (not shown), each target is constituted by a shape discontinuity, such as an indented or projecting piece in relief. In such a situation, the sensor can be a capacitive sensor or indeed an inductive sensor if the discontinuity is made of a conductive material.

In another variant (not shown), each target is constituted by a material discontinuity that comprises an electrically conductive material instead of a magnetic material as in the first embodiment. In such a situation, the sensor can be inductive.

In another variant (not shown), each target forms a physical property discontinuity that may optionally be made of the same material as the part to which it is fastened. The sensor is configured to detect this physical property discontinuity, but not necessarily to withstand high voltages.

Such a physical property discontinuity may, for example, be formed by a variation in surface state. At least one target is formed by a zone of a rotary part that is polished in such a manner as to reflect the light rays emitted by an optical emitter-receiver that forms the sensor. The optical emitter-receiver may be constituted by a light barrier.

In this variant, the electrically insulating wall is made of a transparent material. The optical emitter-receiver is totally surrounded by said transparent wall, thereby fully isolating the components that perform the detection from the target and avoiding any risk of electric arcing towards said sensor. Thus, the optical emitter-receiver can be installed very close to the target, in particular within sight of it, thereby requiring little or no optical fiber.

In another variant (not shown), the rotary drive means for driving the atomizer member in rotation comprise an electric motor instead of an air turbine.

In yet another variant (not shown), the insulating wall may be made of a plurality of different materials that are juxtaposed in layers.

In the example of FIGS. 1 to 4, the invention is described for an electrostatic atomizer for spraying coating material in powder form. However, the invention also applies to electrostatic atomizers for spraying coating material in liquid form. The structural modifications for adapting an electrostatic atomizer for spraying coating material in powder form to make it suitable for spraying material in liquid form are conventional and are therefore not described in the present application.

The invention claimed is:

1. An atomizer for electrostatically spraying coating material in liquid or in powder form, said atomizer comprising:

an electrically insulating atomizer body;

an atomizer member for spraying coating material, wherein the atomizer member is mounted to rotate relative to the electrically insulating atomizer body and about an axis of rotation;

rotary drive means for driving the atomizer member in rotation and having a casing secured to a downstream portion of the electrically insulating atomizer body;

electrical power supply means arranged for raising the potential of the atomizer member to high voltage;

conductive elements that are electrically connected to the electrical power supply means, the potential of the conductive elements being suitable for being raised to high voltage; and a detector device for evaluating the speed of rotation of the atomizer member, the detector device comprising:

at least one target disposed on a rotary component belonging to the atomizer, and a sensor fastened in the atomizer, the sensor being configured to detect the or each target, the sensor being equipped with a link cable for linking it to a remote processor unit for processing the signal;

said atomizer being characterized in that the electrically insulating atomizer body comprises at least one insulating wall formed integrally with the electrically insulating atomizer body, the wall defining a recess surrounding the sensor and all or some part of the link cable in a manner to insulate the entire sensor and all or some part of the cable link electrically from the conductive elements, the wall comprising an axial portion which extends radially toward the axis of rotation of the atomizer member and which is disposed between a downstream axial surface of the recess and an upstream surface of the casing in a direction parallel to the axis of rotation;

wherein the target is separated from the detector only by the insulating wall formed integrally with the electrically insulating atomizer body.

2. The atomizer according to claim 1, wherein the sensor is separated from the volume swept by the rotating target by a detection distance extending parallel to the axis of rotation.

3. The atomizer according to claim 1, wherein a portion of the wall extends facing the sensor on one side and facing the volume swept by the rotating target on the other side, said portion of the wall being disposed axially between the sensor and the volume swept by the rotating target.

4. The atomizer according to claim 3, wherein said portion of the wall and the volume swept by the rotating target are separated by an axial distance lying in the range 1 mm to 10 mm.

5. The atomizer according to claim 1, wherein the wall has a thickness greater than 3 mm when the potential of the atomizer member is to be raised to more than 50 kV.

6. The atomizer according to claim 1, wherein the recess extends in a direction that is parallel to the axis of rotation.

7. The atomizer according to claim 1, wherein the sensor is selected from among the group comprising a magnetic sensor, a magneto-resistive sensor, a Hall-effect sensor, an inductive sensor, a magneto-inductive sensor, and a capacitive sensor.

8. The atomizer according to claim 1, wherein at least one material forming the wall is selected from among the group comprising: polyoxy-methylene copolymer (POM C), polyethylene terephthalate (PETP), polyvinyl chloride (PVC), polyethylene (PE), polypropylene (PP), polyetheretherketone (PEEK), and poly-tetrafluoroethylene (PTFE).

9. The atomizer according to claim 1, wherein the rotary drive means comprise a turbine provided with a bladed wheel, and in that the rotary component is constituted by the bladed wheel, the or each target being disposed on an axial surface of the bladed wheel.

10. The atomizer according to claim 1, wherein the or each target is constituted by a material discontinuity, the or each target comprising, a conductive material or a magnetic material.

11. The atomizer according to claim 1, wherein the or each target is constituted by a physical property discontinuity.

12. The atomizer according to claim 1, wherein the conductive elements belong to the atomizer member, to the rotary drive means, and to the electrical power supply means.

13. The atomizer according to claim 1, wherein the at least one target is disposed on the atomizer member.

14. The atomizer according to claim 1, wherein the at least one target is disposed on one of the rotary drive means.

* * * * *